United States Patent [19]

Walker et al.

[11] Patent Number: 4,681,737

[45] Date of Patent: Jul. 21, 1987

[54] STABILIZED SODIUM ERYTHORBATE BOILER CORROSION INHIBITOR COMPOSITIONS AND METHODS

[75] Inventors: Jerry L. Walker, Coraopolis; John D. Zupanovich, Pittsburgh, both of Pa.

[73] Assignee: Calgon Corporation, Pittsburgh, Pa.

[21] Appl. No.: 777,046

[22] Filed: Sep. 17, 1985

[51] Int. Cl.[4] ..... C23F 11/04; C02F 1/70; C09K 3/00

[52] U.S. Cl. ..... 422/16; 422/11; 210/750; 210/757; 252/188.28; 252/178; 252/389.62

[58] Field of Search ..... 252/188.28, 178, 392 252/396, 403, 407, 389.62, 400.62; 210/750, 757; 422/11, 14, 16; 549/204

[56] References Cited

U.S. PATENT DOCUMENTS

| | | | |
|---|---|---|---|
| 2,297,212 | 9/1942 | Gockel | 549/204 X |
| 3,962,113 | 6/1976 | Shiessl et al. | 252/188.28 X |
| 4,096,090 | 6/1978 | Noack | 252/400.53 X |
| 4,289,645 | 9/1981 | Muccitelli | 252/188.28 X |
| 4,454,046 | 6/1984 | Wallace et al. | 210/750 X |
| 4,487,708 | 12/1984 | Muccitelli | 252/178 |
| 4,512,909 | 4/1985 | Schiessl | 252/188.28 |
| 4,549,968 | 10/1985 | Muccitelli | 252/393 X |

FOREIGN PATENT DOCUMENTS

| | | | |
|---|---|---|---|
| 1168950 | 6/1984 | Canada | 210/750 |

OTHER PUBLICATIONS

Chemical Abstract No. 91:59488, "Deoxidant Chip of High Activity", vol. 9, (1979), p. 142.

*Primary Examiner*—John F. Terapane
*Assistant Examiner*—Matthew A. Thexton
*Attorney, Agent, or Firm*—W. C. Mitchell; R. B. Olson; M. C. Sudol, Jr.

[57] ABSTRACT

A method of inhibiting corrosion due to dissolved oxygen is disclosed, whereby chelant-stabilized sodium erythorbate, alone or in combination with conventional corrosion inhibitors, is added to boiler water to prevent corrosion by reducing dissolved oxygen levels in boiler feedwater.

9 Claims, No Drawings

STABILIZED SODIUM ERYTHORBATE BOILER CORROSION INHIBITOR COMPOSITIONS AND METHODS

BACKGROUND OF THE INVENTION

This invention relates to a method for inhibiting corrosion in boiler feedwater systems and boilers due to dissolved oxygen comprising adding to boiler feedwater chelant-stabilized sodium erythorbate, alone or in combination with scale/deposit inhibitors such as chelants, dispersants, sequestrants, polyelectrolytes, and organic and inorganic phosphates, or conventional boiler corrosion inhibitors such as methoxypropylamine, cyclohexylamine, diethylethanolamine, morpholine, diethyl hydroxylamine, dimethyl amino-2-propanol, 2-amino 2-methylpropanol and carbohydrazide.

More particularly, this invention relates to the use of ethylene diamine tetraacetic acid (EDTA) or nitrilotriacetic acid (NTA) stabilized sodium erythorbate, alone or in combination with conventional boiler scale, deposit and/or corrosion inhibitors, to control corrosion in boiler feedwater systems and boilers.

This invention additionally relates to a method of stabilizing sodium erythorbate against oxidative degradation, and to stabilized sodium erythorbate compositions.

Protection of boiler feedwater systems is becoming an increasingly important aspect of plant operation. The presence of dissolved oxygen in boiler feed water is a primary cause of waterside corrosion. In these energy-conscious times, an increase in the quality of boiler feedwater results in cost savings for the total boiler system.

Historically, the action of dissolved gases such as oxygen and carbon dioxide have been two of the main factors that lead to water feed system and boiler corrosion. In order to understand the role of dissolved gases in corrosion, one must understand the electrochemical nature of corrosion. Under most conditions, there is a tendancy for iron to dissolve in water, and two electrons are released for each iron atom that dissolves. These electrons transfer to hydrogen ions present in the water, and the ions are reduced to elemental gaseous hydrogen. All action ceases at this point if the hydrogen remains on the surface of the metal since a protective coating forms with the passage of electrons. However, any agent which increases the number of hydrogen ions present in the water, or which will cause the removal of the protective film, serves to increase the rate of corrosion.

The presence of oxygen in boiler feedwater causes a two-fold reaction to occur. Some molecules of oxygen combine with displaced hydrogen, thereby exposing the metal to fresh attack. Other oxygen molecules combine with iron ions to form insoluble iron oxide compounds.

The first product of corrosion may be ferric oxide, which is only loosely adherent and aggravates corrosion by blocking off areas to oxygen access. These areas become anionic and iron oxide couples are set up. The iron under the oxide deposit then dissolves, and pitting develops.

With respect to oxygen, the severity of attack will depend on the concentration of dissolved oxygen in the water, water pH and temperature. As water temperature increases, corrosion in feed lines, heaters, boilers, steam and return lines made of iron and steel increases.

The inventors have discovered a new improved method for control of corrosion in boiler feedwater systems and boilers.

A major approach to reducing oxygen in boiler feedwater is mechanical deaeration. Efficient mechanical deaeration can reduce dissolved oxygen to as low as 5–10 ppb in industrial plants and 2–3 ppb in utility operations. However, even with this trace amount of oxygen, some corrosion may occur in boilers. Removal of the last traces of oxygen from boiler feedwater is generally accomplished by the addition of chemicals that react with oxygen and which are hereinafter referred to as oxygen scavengers.

Several oxygen scavengers are known in the art. Widely used oxygen scavengers include, but are not limited to, sodium sulfite, hydrazine, diethylhydroxylamine, carbohydrazide and hydroquinone. U.S. Pat. No. 3,551,349 discloses the use of quinones, particularly hydroquinone, as catalysts for the hydrazine-oxygen reaction. U.S. Pat. No. 4,096,090 discloses the use of hydrazine compounds, a catalytic organometallic complex, and preferably a quinone compound for deoxygenating feedwater. U.S. Pat. No. 3,808,138 discloses the use of cobalt maleic acid hydrazide with hydrazine for oxygen removal. U.S. Pat. No. 3,962,113 discloses the use of organic hydrazine such as monoalkyl hydrazine, dialkyl hydrazine and trialkyl hydrazine as oxygen scavengers.

Disadvantages of hydrazine and related compounds include toxicity and suspected carcinogenic effects. Hydrazine is toxic if inhaled, and is also an irritant to the eyes and skin.

Carbohydrazide, a derivative of hydrazine, decomposes to form hydrazine and carbon dioxide at temperatures above 360° F. U.S. Pat. No. 4,269,717 discloses the use of carbohydrazide as an oxygen scavenger and metal passivator.

U.S. Pat. Nos. 4,278,635 and 4,282,111 disclose the use of hydroquinone, among other dihydroxy, diamino and amino hydroxy benzenes, as oxygen scavengers. U.S. Pat. Nos. 4,279,767 and 4,487,708 disclose the use of hydroquinone and "mu-amines", which are defined as amines which are compatible with hydroquinone. Methoxypropylamine is a preferred mu-amine. U.S. Pat. No. 4,363,734 discloses the use of catalyzed 1,3-dihydroxy acetone as an oxygen scavenger. U.S. Pat. No. 4,419,327 discloses the use of amine or ammonia neutralized erythorbates as oxygen scavengers. Additionally, diethylhydroxylamine (DEHA) has been used as an oxygen scavenger, and U.S. Pat. No. 4,192,844 discloses the use of methoxypropylamine and hydrazine as a corrosion inhibiting composition. European Pat. No. 0054345 discloses the use of amino-phenol compounds or acid addition salts thereof as oxygen scavengers.

UK Patent Application No. 2138796A discloses the use of trivalent phenols, preferably pyrogallol, to improve the activity of hydrazine-trivalent cobalt compositions.

DETAILED DESCRIPTION OF THE INVENTION

The instant invention is directed to a method for controlling corrosion in boilers and boiler feedwater systems comprising adding to boiler feedwater containing dissolved oxygen an effective amount of a chelant-stabilized sodium erythorbate and, optionally, a second oxygen scavenger or neutralizing amine selected from the group consisting of hydroquinone, methoxypropylamine, cyclohexylamine, diethylethanolamine, morpholine, diethyl hydroxylamine, dimethyl amino-2-propanol, 2-amino 2-methylpropanol, and carbohydrazide.

The instant invention is further directed to a method of stabilizing sodium erythorbate comprising adding to said sodium erythorbate an effective amount of a chelant and to the stabilized sodium erythorate of a chelant and to the stabilized sodium erythorate compositions thus obtained.

The instant invention is also directed to corrosion inhibiting compositions comprising: (a) a chelant-stabilized sodium erythorbate; and (b) a compound selected from the group consisting of hydroguinone, methoxypropylamine, cyclohexylamine, diethylethanolamine, morpholine, diethyl hydroxylamine, dimethyl amino-2-propanol, 2-amino 2-methylpropanol, and carbohydrazide.

As used herein, the term "effective amount" is that amount of chelant which stabilizes sodium erythorbate against oxidative degradation and that amount of chelant-stabilized sodium erythorbate which inhibits corrosion when added to boiler feedwater.

Any chelant can be used. Examples include, but are not limited to, ethylene diamine tetraacetic acid (EDTA), nitrilotriacetic acid (NTA), N(hydroxyethyl-)ethylenediaminetriacetic acid, and citric acid, and salts thereof. The preferred chelants are ethylene diamine tetraacetic acid and nitrilotriacetic acid.

The chelant unexpectedly retards oxidative degradation of sodium erythorbate. Erythorbate degradation shortens shelf life, causing loss of erythorbate activity and making erythorbate inconvenient to use. For proper stabilization, an effective amount of chelant should be used. Preferably, the chelant dosage should be about 0.1 to 100 weight percent of the sodium erythorbate being stabilized, based on active sodium erythorbate. A more preferred dosage is 1 to 50 weight percent on an active weight basis. Thus, the preferred chelant:sodium erythorbate weight ratio ranges from about 0.001:1 to 1:1, more preferably from about 0.01:1 to 0.5:1.

The stabilized sodium erythorbate compositions of the instant invention may be used at any effective dosage. Dosages of from about 0.1 to about 1,000 parts per million in the feedwater being treated are preferred, with dosages of from about 1 to about 100 parts per million being most preferred. The preferred mole ratio of sodium erythorbate:$O_2$ ranges from 0.01:1.0 to 100:1, with the most preferred mole ratio ranging from 0.1:1 to 20:1.

Optionally, stabilized sodium erythorbate compositions may be used in combination with other known corrosion inhibitors. When used in combination with a second corrosion inhibitor, the ratio of the stabilized erythorbate to the second corrosion inhibitor should be from 1:99 to 99:1, by weight, preferably 1:50 to 50:1 and most preferably 10:1 to 1:10. At least 0.1 ppm to about 1,000 ppm of such a composition should be added. The preferred dosage is 1 to 100 ppm of such a composition.

The compositions of this invention may be fed to the boiler feedwater by any means known in the art. Thus, the instant compositions may be pumped into boiler feedwater tanks or lines, or added by some other suitable means. Though for convenience purposes it is recommended that stabilized sodium erythorbate and the second corrosion inhibitor, if used, be added as a composition, they may be added separately without departing from the spirit or scope of this invention.

Additionally, the inventors note that chelants may be used to stabilize other salts of erythorbic acid, and erythorbic acid itself.

EXAMPLES

The examples compare the effects of ethylene diamine tetraacetic acid and nitrilotriacetic acid on the oxidative degradation of sodium erythorbate. The results are shown in Table I, below.

In these examples, stabilized or unstabilized aqueous solutions of sodium erythorbate were placed in a capped flask and allowed to sit for 3 days or 26 days. After sitting, the percent active sodium erythorbate was measured by titration and compared to the starting sodium erythrobate concentration of approximately 10%. The percent chelant values shown in Table I are weight percents, based on the total weight of the aqueous solution being tested.

It is not intended by the inventors that the examples be construed as in any way limiting the scope of the instant invention.

TABLE I

| | Fresh | 3 Days | 26 Days |
|---|---|---|---|
| 10% Na Erythorbate | 10.2<br>9.9 | 9.8 | 9.7<br>9.5 |
| 10% Na Erythorbate + 1% Active EDTA | 9.9 | 10.0 | 9.9 |
| 10% Na Erythorbate + 3% Active EDTA | 10.2 | 9.9 | 10.0 |
| 10% Na Erythorbate + 5% Active EDTA | 10.0 | 9.8 | 9.8 |
| 10% Na Erythorbate + 1% NTA | 10.3 | 9.9 | 9.8 |
| 10% Na Erythorbate + 3% NTA | 9.9 | 9.9 | 9.9 |
| 10% Na Erythorbate + 5% NTA | 10.0 | 9.9 | 9.6 |

EDTA = ethylene diamine tetraacetic acid
NTA = nitrilotriacetic acid

What is claimed is:

1. A method of inhibiting corrosion in boilers comprising adding to boiler feedwater containing oxygen an effective amount of a chelant-stabilized aqueous solution of sodium erythorbate, wherein said chelant is selected from the group consisting of nitrilotriacetic acid, ethylenediamine tetraacetic acid, N(hydroxyethyl-)ethylenediamine triacetic acid, citric acid, and salts thereof, and wherein said chelant is present at a chelant-:sodium erythorbate weight ratio of from about 0.001:1 to 1:1, based on active sodium erythorbate.

2. The method of claim 1, wherein said chelant-stabilized sodium erythorbate is added at a dosage of from about 0.1 ppm to about 1,000 ppm.

3. The method of claim 1, wherein said chelant-stabilized sodium erythorbate is added at a dosage of from about 1 to about 100 ppm.

4. The method of claim 1, wherein said chelant is nitrilotriacetic acid or ethylenediamine tetraacetic acid.

5. A composition comprising: (a) an aqueous solution of sodium erythorbate and (b) a chelant selected from the group consisting of nitrilotriacetic acid, ethylenediamine tetraacetic acid, N(hydroxyethyl)ethylenediamine triacetic acid, citric acid, and salts thereof, wherein said chelant is present at a chelant:sodium erythorbate weight ratio of from about 0.001:1 to 1:1, based on active sodium erythorbate, and wherein said sodium erythorbate is stabilized by said chelant against oxidative degradation.

6. The composition of claim 5, wherein said chelant is selected from the group consisting of ethylene diamine tetraacetic acid and nitrilotriacetic acid.

7. A method of stabilizing an aqueous solution of sodium erythorbate against oxidative degradation comprising adding to said sodium erythorbate aqueous solution an effective amount of a chelant selected from the group consisting of nitrilotriacetic acid, ethylenediamine tetraacetic acid, N(hydroxyethyl)ethylenediamine triacetic acid, citric acid, and salts thereof.

8. The method of claim 7, wherein said chelant is selected from the group consisting of ethylene diamine tetraacetic acid and nitrilotriacetic acid.

9. The method of claim 7, wherein said chelant is added so as to provide a chelant:sodium erythorbate weight ratio of from about 0.001:1 to 1:1.

* * * * *